US008866368B2

(12) United States Patent
Yu et al.

(10) Patent No.: US 8,866,368 B2
(45) Date of Patent: Oct. 21, 2014

(54) LED LIGHT BULB

(75) Inventors: Lufan Yu, Xiamen (CN); Zhongcheng Wu, Xiamen (CN); Hong Wang, Xiamen (CN)

(73) Assignee: Xiamen Yankon Energetic Lighting Co., Ltd., Xiamen, Fujian (CN)

( * ) Notice: Subject to any disclaimer, the term of this patent is extended or adjusted under 35 U.S.C. 154(b) by 0 days.

(21) Appl. No.: 14/006,128

(22) PCT Filed: Sep. 16, 2011

(86) PCT No.: PCT/CN2011/079749

§ 371 (c)(1), (2), (4) Date: Sep. 19, 2013

(87) PCT Pub. No.: WO2012/139358

PCT Pub. Date: Oct. 18, 2012

(65) Prior Publication Data

US 2014/0021849 A1 Jan. 23, 2014

(30) Foreign Application Priority Data

Apr. 14, 2011 (CN) ..... 2011 1 0094207

(51) Int. Cl.

| | |
|---|---|
| ***H01J 7/26*** | (2006.01) |
| ***H01J 61/52*** | (2006.01) |
| ***H01J 1/58*** | (2006.01) |
| ***F21V 29/00*** | (2006.01) |
| ***F21S 2/00*** | (2006.01) |
| ***F21K 99/00*** | (2010.01) |
| *F21Y 101/02* | (2006.01) |

(52) U.S. Cl.

CPC . *F21K 9/00* (2013.01); *F21V 29/00* (2013.01); *F21Y 2101/02* (2013.01); *F21V 29/262* (2013.01); *F21V 29/2293* (2013.01); *F21S 2/00* (2013.01); *F21K 9/13* (2013.01)

USPC ..... 313/36; 362/373; 362/249.02

(58) Field of Classification Search

CPC ... F21V 29/004; F21V 29/00; F21Y 2101/02; F21Y 29/262; F21Y 29/2293; F21S 2/00; F21K 9/13; F21K 9/00

USPC ..... 313/36

See application file for complete search history.

(56) References Cited

U.S. PATENT DOCUMENTS

2007/0253202 A1* 11/2007 Wu et al. ..... 362/294
2008/0266866 A1* 10/2008 Tsai ..... 362/294

* cited by examiner

*Primary Examiner* — Donald Raleigh

(57) ABSTRACT

An LED light bulb includes a bulb housing, at least two heat sinks, an LED chip connected on each of the heat sinks, a circuit board driving the LED chip to work, a bulb base, and a bulb cap. The inner sides of the heat sinks encircle into an air cavity. Each heat sink has a first opening. The bulb base has a second opening. The first opening is exposed in the second opening to communicate with the air cavity. The top end of the bulb housing has a third opening to communicate with the air cavity. The air cavity forms up-and-down circulating convection air via the three openings.

12 Claims, 11 Drawing Sheets

LED LIGHT BULB

BACKGROUND OF THE INVENTION

1. Field of the Invention

The present invention relates to an illumination apparatus, and more particularly to an LED light bulb.

2. Description of the Prior Art

An LED is made of an electroluminescent semiconductor material, which has lower voltage, high efficiency, good monochromaticity, good applicability, good stability, short time of response, long service, no pollution and the like so it is widely used in the field of illumination or decoration. An LED bulb with LED chips is developed. The difference between the LED bulb and the traditional incandescent bulb is that the illuminating member in the bulb is replaced with the LED chips. With the development of small-sized bulbs, the junction temperature and heat dissipation of the LED chips becomes more and more important for the small-sized bulbs. If the problem of the junction temperature and heat dissipation of the LED chips cannot be solved, it will influence the promotion of the small-sized bulbs. Accordingly, the inventor of the present invention has devoted himself based on his many years of practical experiences to solve this problem.

SUMMARY OF THE INVENTION

The primary object of the present invention is to provide an LED light bulb to solve the problem of the prior art. The LED light bulb can solve the problem of the junction temperature and heat dissipation of the LED chips and keep the good properties of the existing LED light bulbs. The heat can be dissipated effectively. This is beneficial for promotion of small-sized LED light bulbs.

In order to achieve the aforesaid object, the LED light bulb of the present invention comprises a bulb housing, at least two heat sinks, an LED chip, a circuit board driving the LED chip to work, a bulb base, and a bulb cap. The upper part of the bulb cap is connected to the bulb base. The circuit board is installed in the bulb base. The bottom of the bulb housing is connected with the upper part of the bulb base. Each of the heat sinks comprises an upper part and a lower part. The heat sinks are mounted on the circumferential portion of the bulb base around a bulb axis. The upper part is accommodated in the bulb housing. The outer side of the upper part is connected with the LED chip. The inner sides of the heat sinks encircle into an air cavity around the bulb axis. The lower part has a first opening. The side wall of the bulb base has second openings which are evenly spaced. The first opening of each heat sink communicates with the corresponding second opening. The top end of the bulb housing has a third opening. The first opening, the second openings and the third opening communicates with the air cavity for circulating up-and-down convection air.

Preferably, each of the heat sinks comprises the upper part having a recess opposite the bulb axis, the lower part having a recess facing the bulb axis, and a bent connecting portion to form a step connected between the upper part and the lower part. The LED chip is fixed in the recess of the upper part. The lower part is connected with the bulb base.

Preferably, the lower part is gradually inclined from top to bottom toward the bulb axis. The lower part has a side opening. The lower part further has an inner piece at an inner side thereof. The bottom end of the inner piece is integrally connected with the bottom end of the inner side of the lower part. The top end of the inner piece and the inner side of the lower part define an upper opening communicating with the side opening of the lower part. The first opening of each heat sink comprises the upper opening and the side opening.

Preferably, the bulb base comprises a bulb base body and a separation cap. The bulb base body comprises a cylindrical circuit board fixing cap and a heat sink installation portion surrounding the outer side of the circuit board fixing cap. The separation cap is connected with the upper end of the circuit board fixing cap. The heat sink installation portion is gradually inclined from top to bottom toward the bulb axis. The second openings of the bulb base are disposed in the heat sink installation portion. Two sides of each second opening have side insertion troughs. Two sides of the lower part are respectively inserted in the side insertion troughs of the corresponding second opening.

Preferably, the bottom end of each second opening has a bottom insertion trough. The bottom end of the lower part is inserted in the bottom insertion trough of the corresponding second opening.

Preferably, the separation cap has connecting posts thereon. The connecting posts are gradually and outwardly inclined. The step of each heat sink has an insertion hole. The insertion holes of the steps of the heat sinks correspond in position to the connecting posts. Each connecting post has a wire hole for passing of the wire of the circuit board installed in the circuit board fixing cap.

Preferably, the third opening has an inward opening flange. The top end of the inner side of each heat sink is against the opening flange.

Preferably, the first opening of the lower part of each heat sink is a plurality of parallel grooves. The lower part is connected with the bulb base. The grooves communicate with the corresponding second opening of the bulb base.

Preferably, the joint of the lower part of each heat sink and the connecting portion has an outside-in transverse trough to form the first opening. The lower part is connected with the bulb base. The transverse trough communicates with the corresponding second opening of the bulb base.

Preferably, the first opening of the lower part of each heat sink is a plurality of holes.

Preferably, the bulb housing comprises an upper bulb housing and a lower bulb housing. The upper bulb housing has the third opening.

Preferably, the third opening of the bulb housing is one of a hole, a plurality of holes, and a plurality grooves.

The heat sinks of the LED light bulb of the present invention are mounted on the circumferential portion of the bulb base around the bulb axis and partially accommodated in the bulb housing. The inner sides of the heat sinks encircle into an air cavity around the bulb axis. The outer side of each heat sink is fixedly connected with the LED chip. The bottom part of each heat sink has a downward first opening. The side wall of the bulb base has second openings which are evenly spaced. The bottom part of the heat sink is mounted in the corresponding second opening of the bulb base so that the first opening of each heat sink appears in the corresponding second opening. The top end of the bulb housing has a third opening. The top end of each heat sink is against the inner side of the third opening. The third opening communicates with the air cavity. The heat dissipation structure of the LED light bulb has the following advantages.

1. The heat sink extends from the top end of the bulb housing to the bulb cap, which is beneficial for heat conduction and heat dissipation.

2. The back of the heat sink has an exposed space for circulating up-and-down convection air, providing a better convection effect.

3. The LED light source is attached to the heat sink, which is beneficial for heat dissipation and provides even light.

DETAILED DESCRIPTION OF THE PREFERRED EMBODIMENTS

Figure 1:
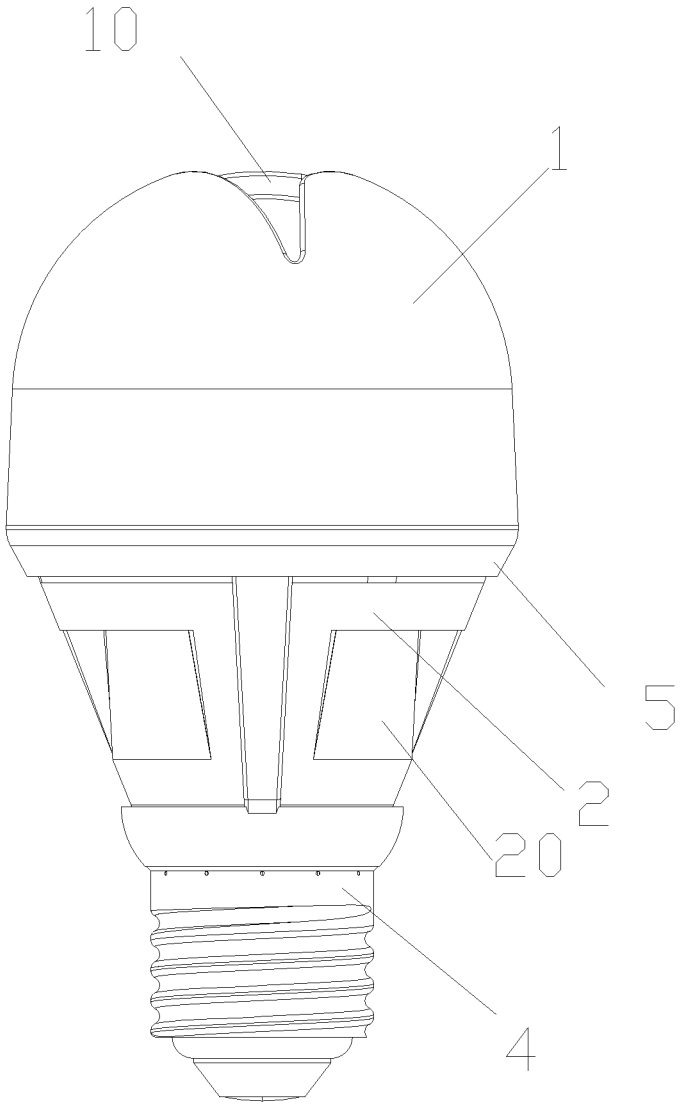
FIG. 1 is a front view according to a first embodiment of the present invention.
Figure 2:
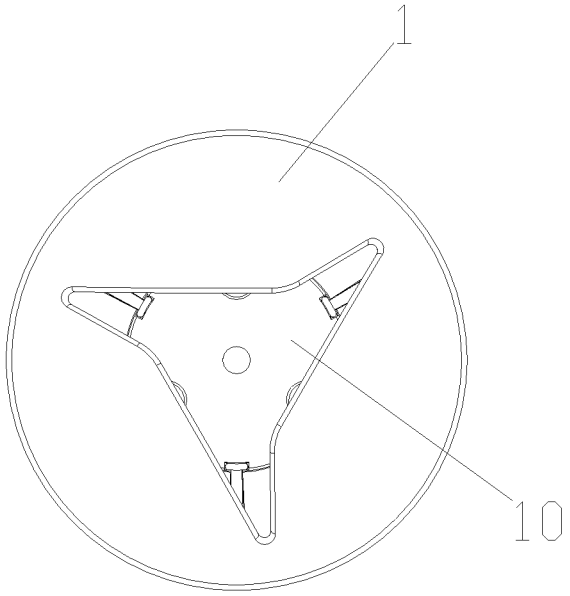
FIG. 2 is a top view according to the first embodiment of the present invention.
Figure 3:
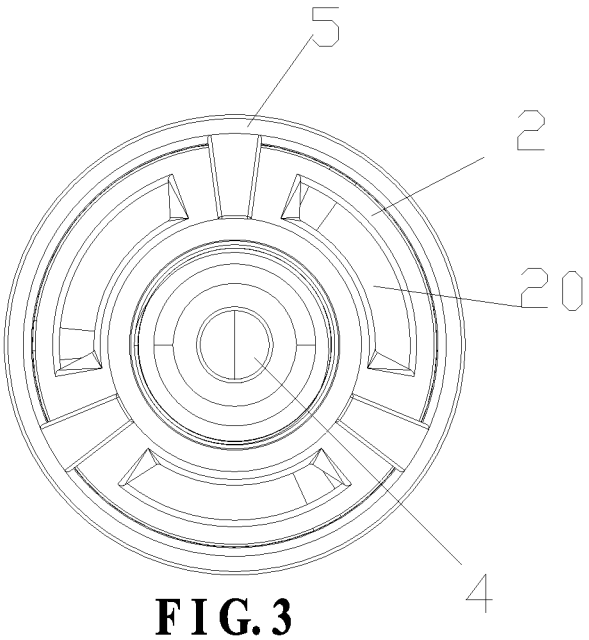
FIG. 3 is a bottom view according to the first embodiment of the present invention.
Figure 4:
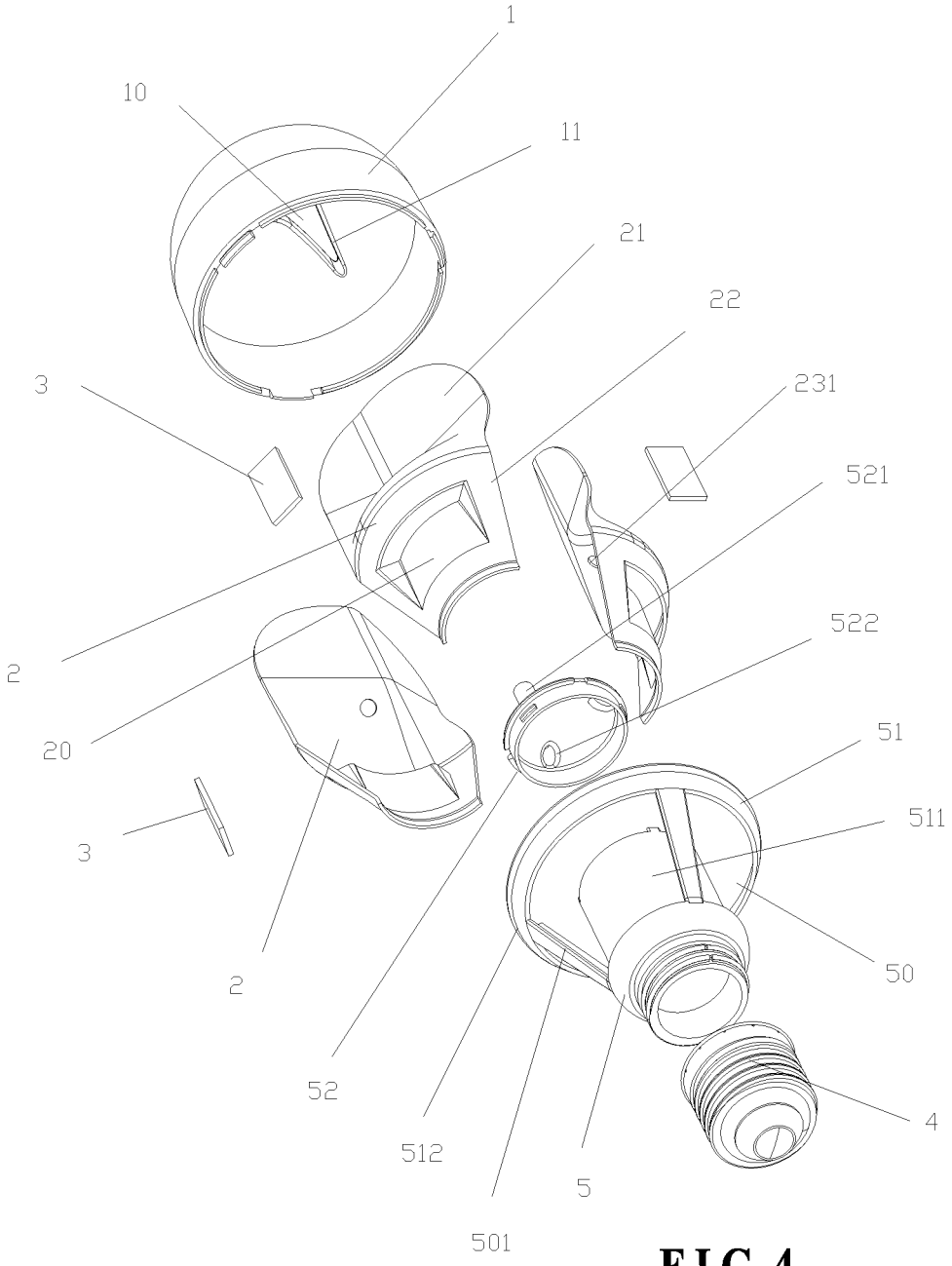
FIG. 4 is an exploded view according to the first embodiment of the present invention.
Figure 5:
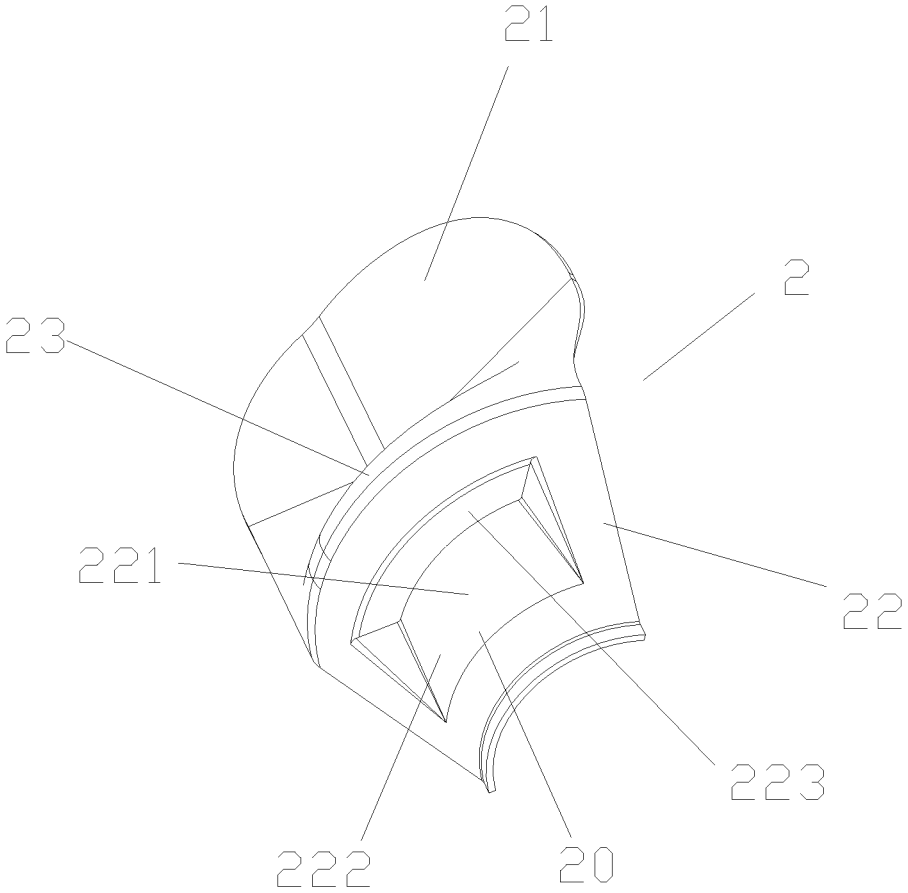
FIG. 5 is a schematic view showing the heat sink according to the first embodiment of the present invention.
Figure 6:
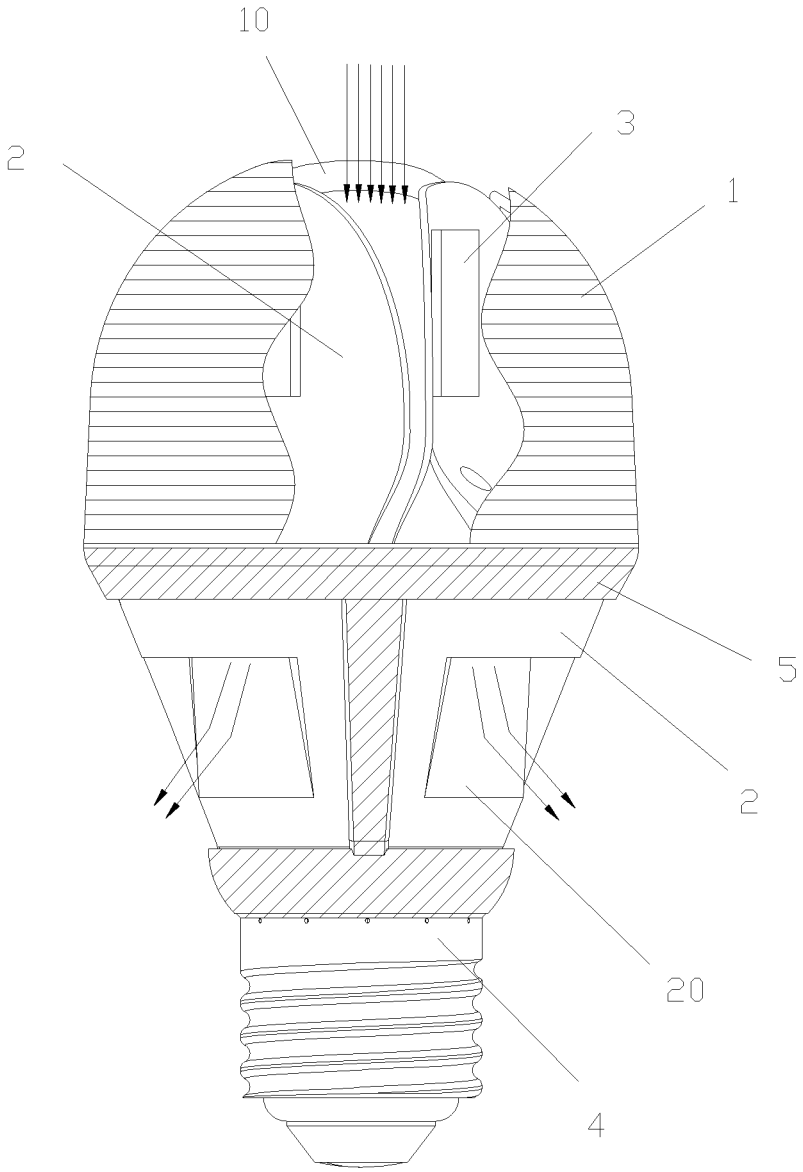
FIG. 6 is a sectional view according to the first embodiment of the present invention.

Embodiments of the present invention will now be described, by way of example only, with reference to the accompanying drawings.

FIG. 1 to FIG. 6 shows an LED light bulb according to a first embodiment of the present invention. The LED light bulb comprises a bulb housing 1, three heat sinks 2, an LED chip 3, a circuit board (not shown in the drawing) driving the LED chip 3 to work, a bulb base 5, and a bulb cap 4. The upper part of the bulb cap 4 is connected to the bulb base 5. (The following description is in the way that the bulb cap is at the lower end, and vice versa). For example, a screw connection is used. The circuit board is installed in the bulb base 5. The bottom of the bulb housing 1 is connected with the upper part of the bulb base 5. The heat sinks 2 are mounted on the circumferential portion of the bulb base 5 around the bulb axis, and partially contained in the bulb housing 1. The inner sides of the three heat sinks 2 encircle into an air cavity around the bulb axis. The outer side of each heat sink 2 is fixedly connected with the LED chip 3. The bottom part of each heat sink 2 has a downward first opening 20. The side wall of the bulb base 5 has second openings 50 which are evenly spaced. The bottom part of the heat sink 2 is mounted in the corresponding second opening 50 of the bulb base 5 so that the first opening 20 of each heat sink 2 appears in the corresponding second opening 50 and communicates with the air cavity. The top end of the bulb housing 1 has a third opening 10. The top end of each heat sink 2 is against the inner side of the third opening 10. The third opening 10 communicates with the air cavity. The air cavity forms up-and-down circulating convection air via the three openings.

Each heat sink 2 comprises an upper part 21 having a recess opposite the bulb axis, a lower part 22 having a recess facing the bulb axis, and a bent connecting portion 23 to form a step connected between the upper part 21 and the lower part 22. The LED chip 3 is fixedly connected in the recess of the upper part 21. The lower part 22 is connected with the bulb base 5.

The lower part 22 is gradually inclined from top to bottom toward the bulb axis. The lower part 22 has a side opening 221. The lower part 22 further has an inner piece 222 at an inner side thereof. The bottom end of the inner piece 222 is integrally connected with the bottom end of the inner side of the lower part 22. The top end of the inner piece 222 and the inner side of the lower part 22 define an upper opening 223 communicating with the side opening 221 of the lower part 22. The first opening 20 of each heat sink 2 comprises the upper opening 223 and the side opening 221.

The bulb base 5 comprises a bulb base body 51 and a separation cap 52. The bulb base body 51 comprises a cylindrical circuit board fixing cap 511 and a heat sink installation portion 512 surrounding the outer side of the circuit board fixing cap 511. The separation cap 52 is connected with the upper end of the circuit board fixing cap 511. The heat sink installation portion 512 is gradually inclined from top to bottom toward the bulb axis. The second opening 50 of the bulb base 5 is disposed in the heat sink installation portion 512. Two sides of the second opening 50 respectively have a side insertion trough 501. Two sides of the lower part 22 are respectively inserted in the side insertion troughs 501 of the corresponding second opening 50.

The bottom end of the second opening 50 has a bottom insertion trough. The bottom end of the lower part 22 is inserted in the bottom insertion trough of the corresponding second opening 50.

The separation cap 52 has connecting posts 521 thereon. The connecting posts 521 are gradually and outwardly inclined. The step of each heat sink 2 has an insertion hole 231. The insertion holes 231 of the steps of the heat sinks 2 correspond in position to the connecting posts 521. Each connecting post 521 has a wire hole 522 for passing of the wire of the circuit board installed in the circuit board fixing cap 511.

The third opening 10 has an inward opening flange 11. The top end of the inner side of each heat sink 2 is against the opening flange 11.

The LED light bulb of the present invention comprises at least two separate heat sinks 2 to constitute a heat dissipation structure. The heat sinks 2 are mounted on the circumferential portion of the bulb base 5 around the bulb axis, and partially contained in the bulb housing 1. The heat sinks 2 extend from the top end of the bulb housing 1 to the bulb cap 4. The inner sides of the heat sinks 2 encircle into an air cavity around the bulb axis. The outer side of each heat sink 2 is fixedly connected with the LED chip 3. The bent lower part of each heat sink 2 has a through hole, namely, the bottom part of each heat sink 2 has a downward first opening 20. The side wall of the bulb base 5 has second openings 50 which are evenly spaced. The bottom part of the heat sink 2 is mounted in the corresponding second opening 50 of the bulb base 5 so that the first opening 20 of each heat sink 2 appears in the corresponding second opening 50. Thus, the first opening 20 of the heat sink 2 is disposed outside the bulb. The top end of the bulb housing 1 has an opening, namely, the top end of the bulb housing 1 has a third opening 10. The top end of each heat sink 2 is against the inner side of the third opening 10. The third opening 10 communicates with the air cavity. Therefore, the back of each heat sink 2 is exposed in the air. The third opening 10 at the top end of the bulb housing 1 and the first opening 20 of each heat sink 2 form convection. The circulating convection air is in the way up-and-down as shown by the arrow in FIG. 6. The outer side of each heat sink 2 is covered by the bulb housing 1. The bottom end of the bulb housing 1 is connected to the bulb base 5, for example, in the way of engagement. Thus, the LED chip 3 fixed on the outer side of the heat sink 2 is located between the bulb housing 1 and the heat sink 2 to provide a light source.

Figure 7:
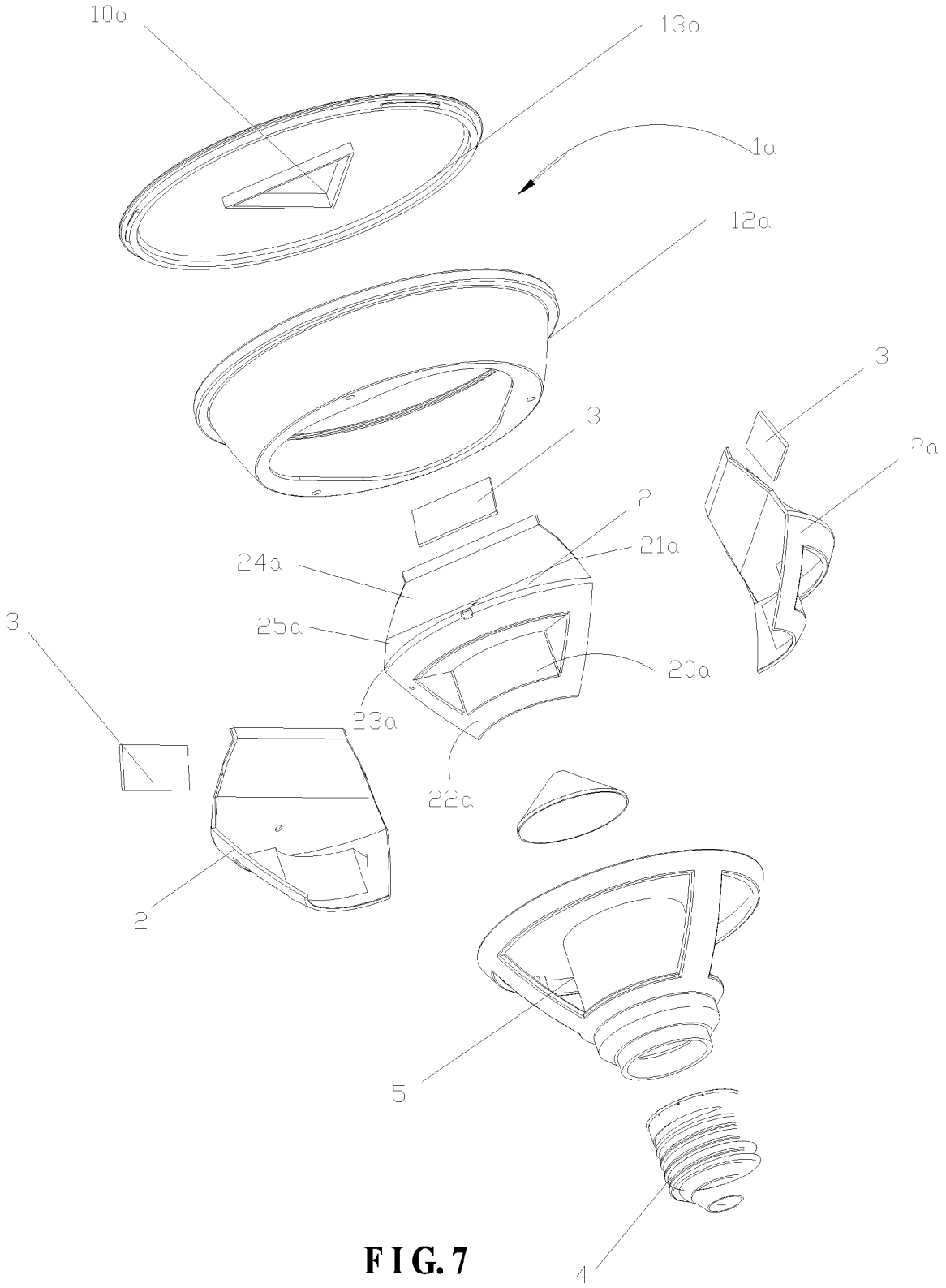
FIG. 7 is an exploded view according to a second embodiment of the present invention.

FIG. 7 shows an LED light bulb according to a second embodiment of the present invention. The second embodiment is substantially similar to the first embodiment with the exceptions described hereinafter. The bulb housing 1*a* comprises a glass plate 13*a* and a lower bulb housing 12*a*. The glass plate 13*a* has a central third opening 10*a*. The glass plate 13*a* is installed on the upper part of the lower bulb housing 12*a*. The heat sink 2*a* comprises an upper part 21*a*, a lower part 22*a*, and a connecting portion 23*a* between the upper part 21*a* and the lower part 22*a*. The lower part 22*a* has a first opening 20*a*. The connecting portion 23*a* has an inclined section 25*a* extending upward from the level and a vertical section 24*a* extending upward from the inclined section 25*a*. The inclined section 25*a* is adapted to install the LED chip 3.

The LED light bulb comprises a bulb housing 1*a*, three heat sinks 2*a*, an LED chip 3, a circuit board driving the LED chip 3 to work, a bulb base 5, and a bulb cap 4. The upper part of the bulb cap 4 is connected to the bulb base 5. The circuit board is installed in the bulb base 5. The bottom of the bulb housing 1 is connected with the upper part of the bulb base 5. The heat sinks 2*a* are mounted on the circumferential portion of the bulb base 5 around the bulb axis, and partially contained in the bulb housing 1. The inner sides of the three heat sinks 2*a* encircle into an air cavity around the bulb axis.

The outer side of each heat sink 2*a* is fixedly connected with the LED chip 3. The bottom part of each heat sink 2*a* has a downward first opening 20*a*. The side wall of the bulb base 5 has second openings 50 which are evenly spaced. The bottom part of the heat sink 2*a* is mounted in the corresponding second opening 50 of the bulb base 5 so that the first opening 20*a* of each heat sink 2*a* appears in the corresponding second opening 50 and communicates with the air cavity. The top end of the bulb housing 1*a* has a third opening 10*a*. The top end of each heat sink 2*a* is against the inner side of the third opening 10*a*. The third opening 10*a* communicates with the air cavity. The air cavity forms up-and-down circulating convection air via the three openings.

Figure 8:
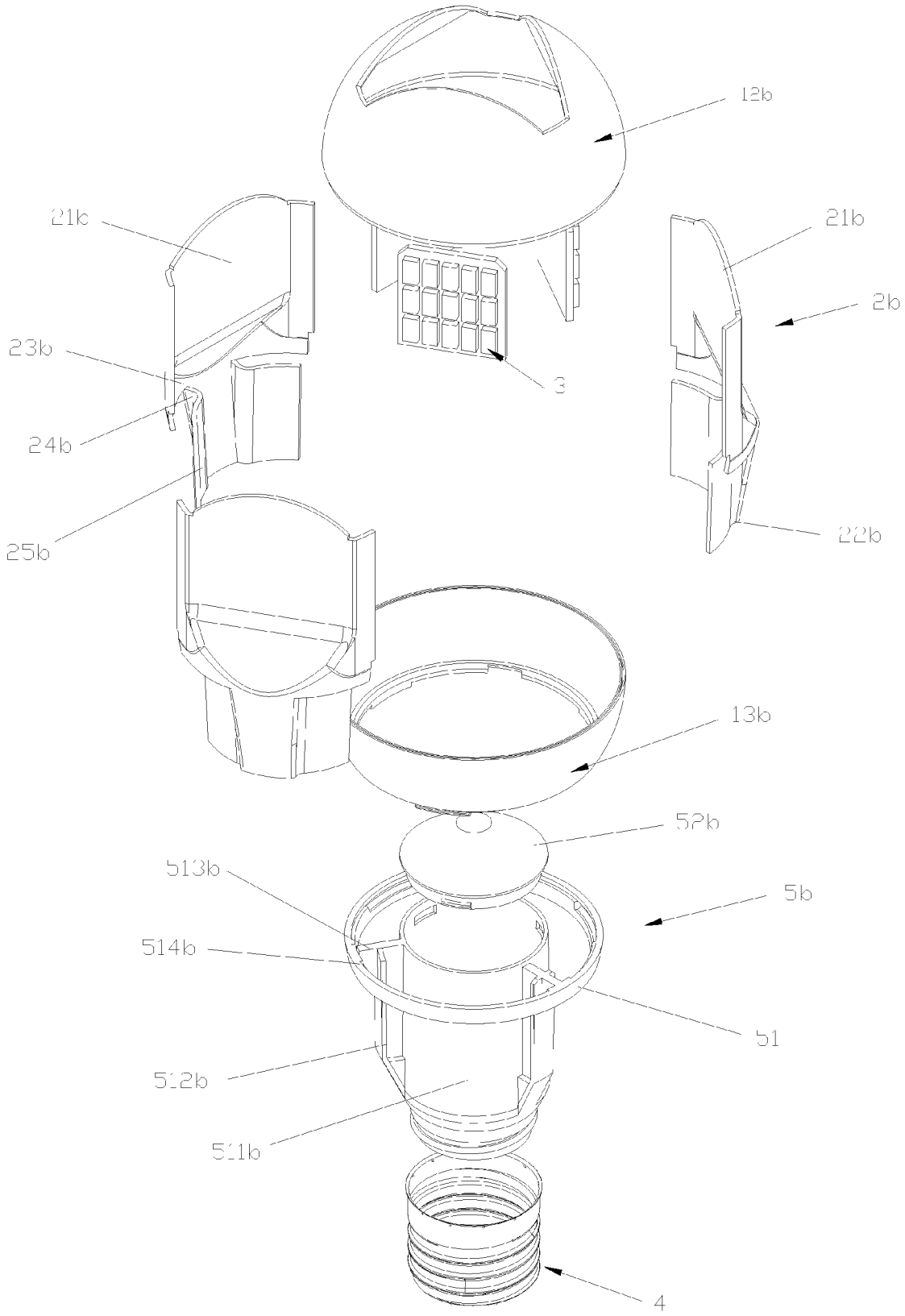
FIG. 8 is an exploded view according to a third embodiment of the present invention.

FIG. 8 shows an LED light bulb according to a third embodiment of the present invention. The differences between the third embodiment and the first embodiment are the heat sink 2*b* and the bulb base 5*b*.

The LED light bulb comprises a bulb housing 1*b*, three heat sinks 2*b*, an LED chip 3, a circuit board driving the LED chip 3 to work, a bulb base 5*b*, and a bulb cap 4. The upper part of the bulb cap 4 is connected to the bulb base 5*b*. The circuit board is installed in the bulb base 5*b*. The bottom of the bulb housing 1*b* is connected with the upper part of the bulb base 5*b*. The heat sinks 2*b* are mounted on the circumferential portion of the bulb base 5*b* around the bulb axis, and partially contained in the bulb housing 1*b*. The inner sides of the three heat sinks 2*b* encircle into an air cavity around the bulb axis. The outer side of the heat sink 2*b* is respectively connected with the LED chip 3.

The heat sink 2*b* comprises an upper part 21*b*, a lower part 22*b*, and a connecting portion 23*b* between the upper part 21*b* and the lower part 22*b*. Two sides of the joint of the lower part 22*b* and the connecting portion 23*b* respectively have an outside-in transverse trough 24*b* to form a first opening 22*b*. Two sides of the lower part 22*b* are bent to form two wings 25*b* under the transverse trough 24*b*.

The bulb base 5*b* comprises a bulb base body 51*b* and a separation cap 52*b*. The bulb base body 51*b* comprises a circuit board fixing cylinder 511*b*, a heat sink installation portion 512*b*, a fixing ring 513*b*, and connecting ribs 514*b*. The fixing ring 513*b* is disposed at the circumferential edge of the upper end of the fixing cylinder 511*b* and connected with the fixing cylinder 511*b* through the three connecting ribs 514*b*. The heat sink installation portion 512*b* is disposed around the fixing cylinder 511*b*. The top of the heat sink installation 512 is fixedly connected with the connecting ribs 514*b* to form a second opening 50*b*.

The separation cap 52*b* is connected with the upper end of the circuit board fixing cylinder 511*b*. The ends of the two wings 25*b* of the lower part 22*b* are respectively inserted to the respective heat sink installation portion 512*b*. The upper part 21*b* passes through the fixing ring 513*b* to extend upward. The lower bulb housing 13*b* is installed on the fixing ring 513*b*. The upper bulb housing 12*b* is installed on the lower bulb housing 13*b*. The top of the upper part 21*b* is against the inner side of the upper bulb housing 12*b*. The upper bulb housing 12*b* has a third opening 10*b*.

Figure 9:
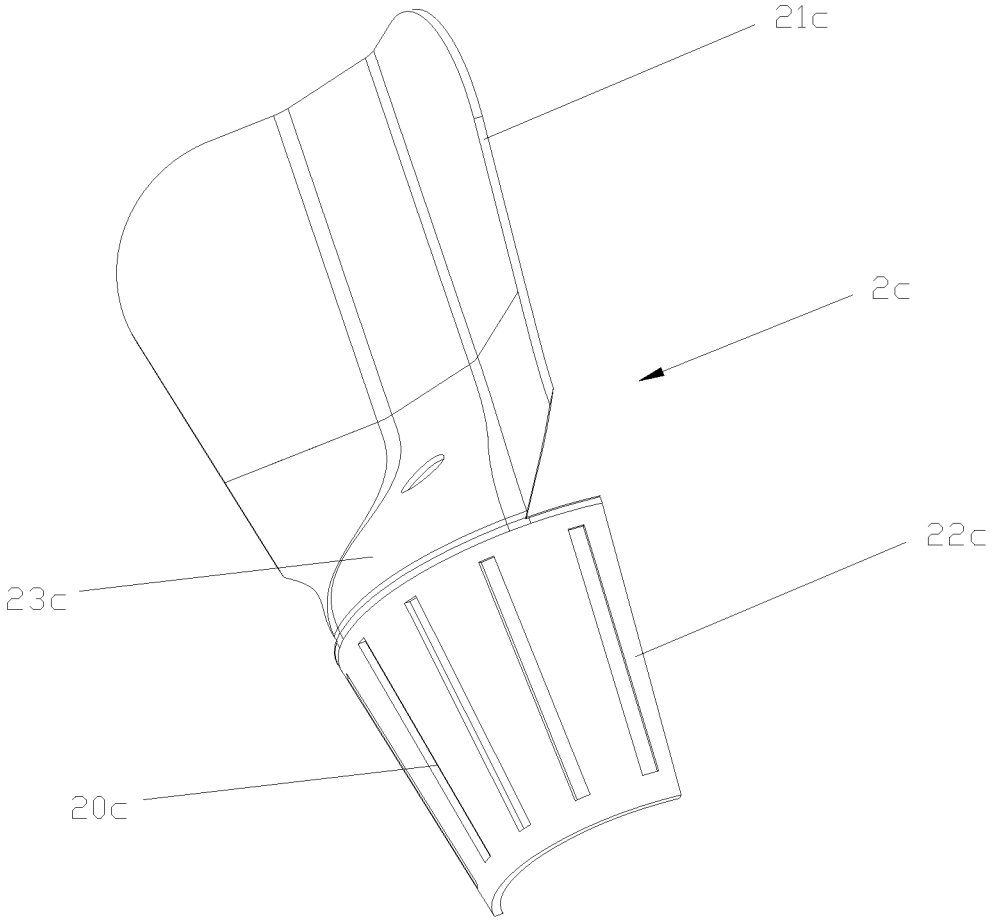
FIG. 9 is a schematic view showing the heat sink according to the fourth embodiment of the present invention.

FIG. 9 shows an LED light bulb according to a fourth embodiment of the present invention. The heat sink 2*c* comprises an upper part 21*c*, a lower part 22*c*, and a connecting portion 23*c* between the upper part 21*c* and the lower part 22*c*. The lower part 22*c* has a plurality of vertical parallel grooves to form first openings 20*c*. The grooves may be arranged transversely or obliquely.

Figure 10:
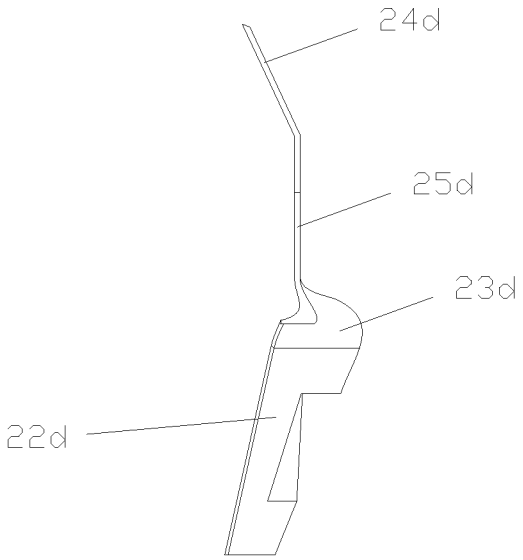
FIG. 10 is a schematic view showing the heat sink according to the fifth embodiment of the present invention.
Figure 11:
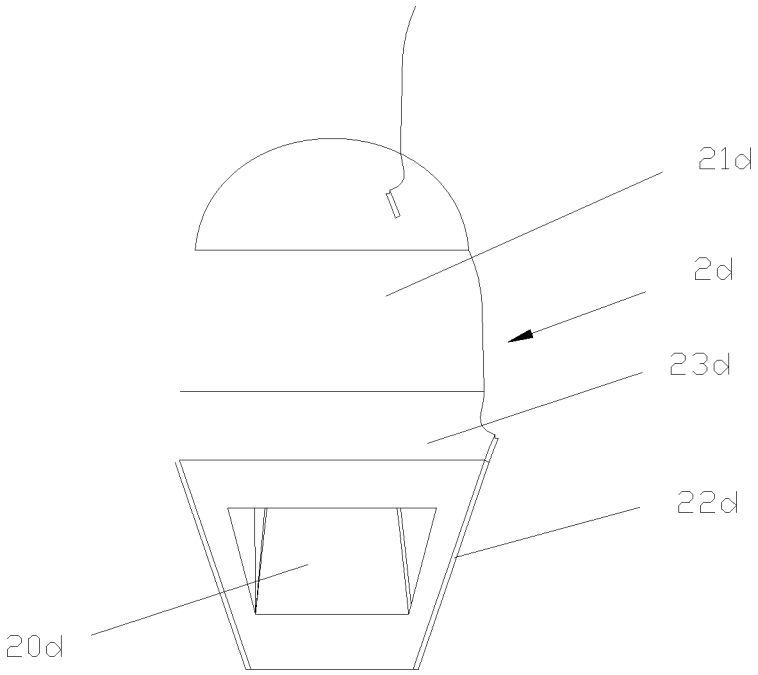
FIG. 11 is a front view of FIG. 10.

FIG. 10 and FIG. 11 show an LED light bulb according to a fifth embodiment of the present invention. The heat sink 2*d* comprises an upper part 21*d*, a lower part 22*d*, and a connecting portion 23*d* between the upper part 21*d* and the lower part 22*d*. The lower part 22*d* has a first opening 20*d*. The upper part 21*d* comprises a vertical section 25*d* and an inclined section 24*d*. The lower end of the vertical section 25*d* is connected with the connecting portion 23*d*. The upper end of the vertical section 25*d* extend upward and obliquely to form the inclined section 24*d*. The LED chip 3 can be installed on both the vertical section 25*d* and the inclined section 24*d*.

Figure 12:
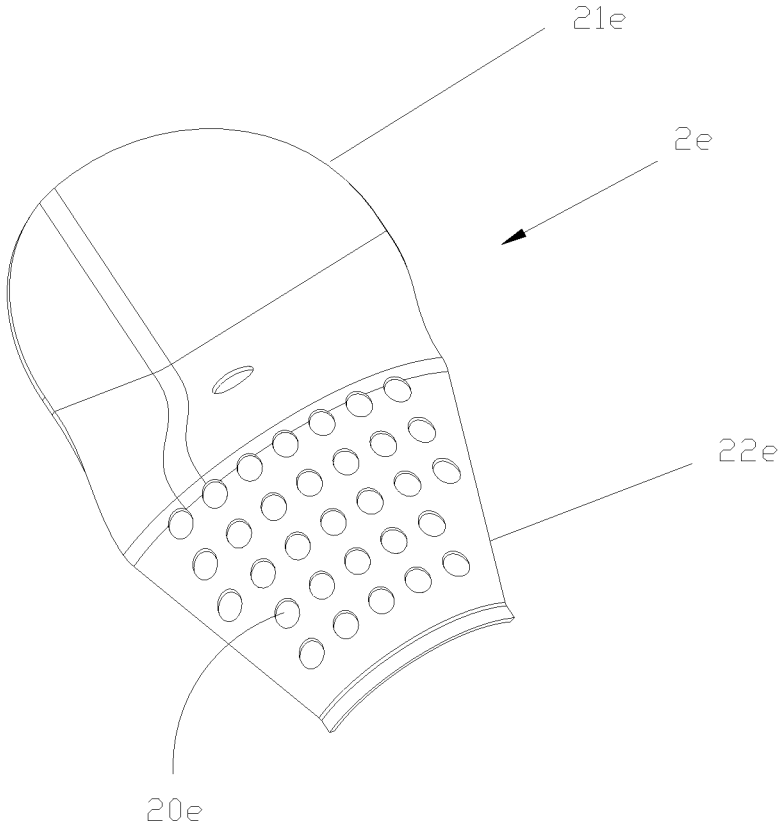
FIG. 12 is a schematic view showing the heat sink according to the sixth embodiment of the present invention.

FIG. 12 shows an LED light bulb according to a sixth embodiment of the present invention. The heat sink 2*e* comprises an upper part 21*e*, a lower part 22*e*, and a connecting portion 23*e* between the upper part 21*e* and the lower part 22*e*. The lower part 22*e* has a plurality of small circular holes to form first openings 20. The holes may be triangular holes, pentagonal holes or other geometric holes.

Figure 13:
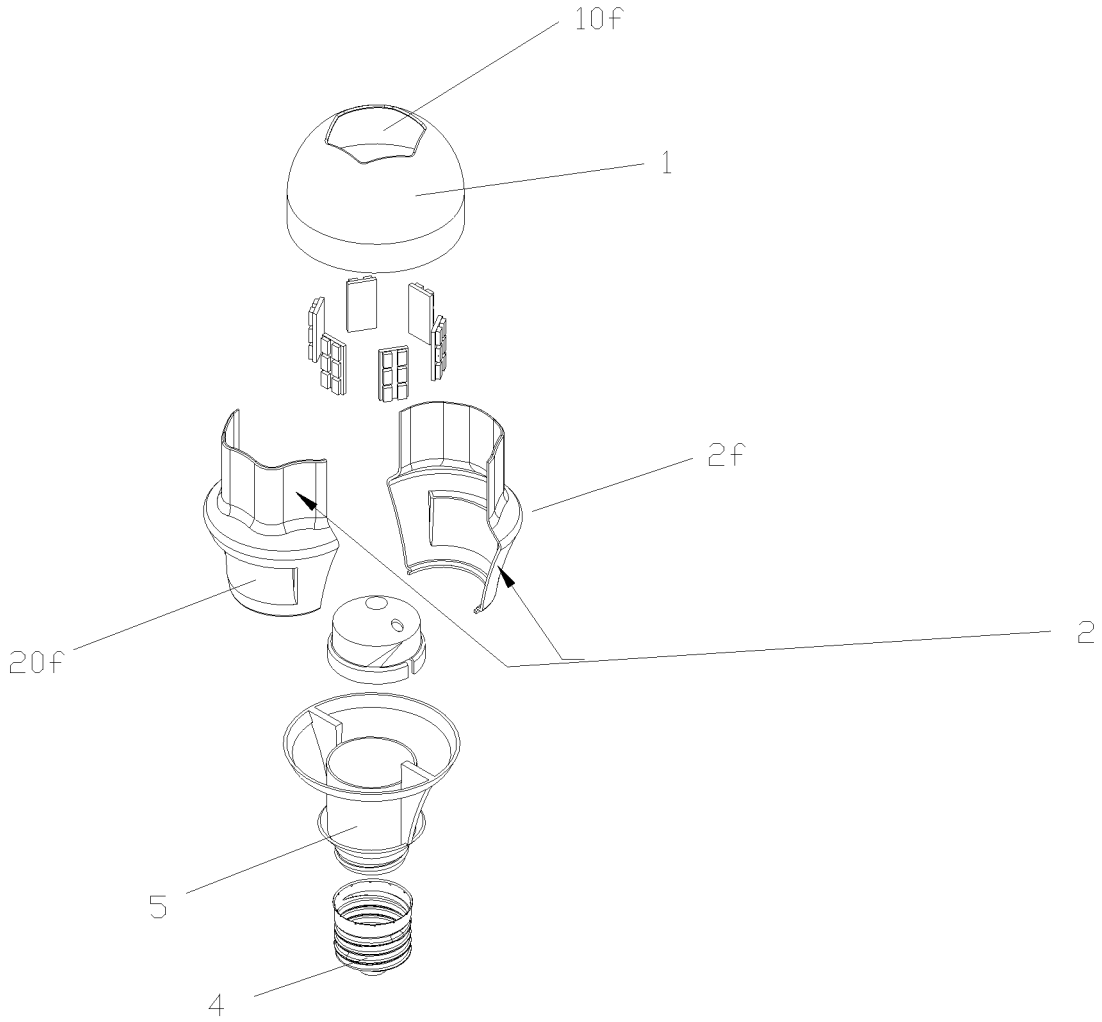
FIG. 13 is a schematic view showing the heat sink according to the seventh embodiment of the present invention.

FIG. 13 shows an LED light bulb according to a seventh embodiment of the present invention. The difference between the seventh embodiment and the first embodiment is that there are two heat sinks 2*f*.

The LED light bulb comprises a bulb housing 1, two heat sinks 2*f*, an LED chip 3, a circuit board (not shown in the drawing) driving the LED chip 3 to work, a bulb base 5, and a bulb cap 4. The upper part of the bulb cap 4 is connected to the bulb base 5. The circuit board is installed in the bulb base 5. The bottom of the bulb housing 1 is connected with the upper part of the bulb base 5. The heat sinks 2 are mounted on the circumferential portion of the bulb base 5 around the bulb axis, and partially contained in the bulb housing 1. The inner sides of the two heat sinks 2 encircle into an air cavity around the bulb axis.

The outer side of each heat sink 2*f* is fixedly connected with the LED chip 3. The bottom part of each heat sink 2*f* has a downward first opening 20*f*. The side wall of the bulb base 5 has second openings 50 which are evenly spaced. The bottom part of the heat sink 2*f* is mounted in the corresponding second opening 50 of the bulb base 5 so that the first opening 20*f* of each heat sink 2*f* appears in the corresponding second opening 50 to communicate with the air cavity. Thus, the first opening 20 of the heat sink 2 is disposed outside the bulb. The top end of the bulb housing 1 has a third opening 10*f*. The top end of each heat sink 2*f* is against the inner side of the third opening 10*f*. The third opening 10*f* communicates with the air cavity. The air cavity forms up-and-down circulating convection air via the three openings.

The LED light bulb of the present invention can solve the problem of the junction temperature and heat dissipation of the LED chip and keep the good properties of the existing bulbs. The heat can be dissipated effectively. This is beneficial for promotion of small-sized LED light bulbs.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. An LED light bulb, comprising a bulb housing, at least two heat sinks, each of which discretely situated neighboring to each other on a same circumference, an LED chip, vertically oriented to be parallel to a flow of air in an air cavity, a circuit board powering the LED chip, a bulb base, and a bulb cap, an upper part thereof being connected to the bulb base, the circuit board being installed in the bulb base, a bottom of the bulb housing being connected with an upper part of the bulb base, each of the heat sinks comprising an upper part and a lower part, a bent connecting portion curving outwards to form a step integrally connected between the upper part and the lower part, the heat sinks being mounted on a circumferential portion of the bulb base around a bulb axis, the upper part being accommodated in the bulb housing, an outer side of the upper part being connected with the LED chip; the inner sides of the heat sinks encircling into the air cavity around the bulb axis, the lower part having a first opening; a side wall of the bulb base having second openings which are evenly spaced, the first opening of each heat sink communicating with the corresponding second opening; a top end of the bulb housing having a third opening; the first opening, the second openings and the third opening communicating with the air cavity for circulating up-and-down convection air.

2. The LED light bulb as claimed in claim 1, wherein each of the heat sinks comprises the upper part having a recess opposite the bulb axis, the lower part having a recess facing the bulb axis, and the LED chip being fixed in the recess of the upper part, the lower part being connected with the bulb base.

3. The LED light bulb as claimed in claim 2, wherein the lower part is gradually inclined from top to bottom toward the bulb axis, the lower part having a side opening, the lower part further having an inner piece at an inner side thereof, a bottom end of the inner piece being integrally connected with a bottom end of the inner side of the lower part, a top end of the inner piece and the inner side of the lower part defining an upper opening communicating with the side opening of the lower part, the first opening of each heat sink comprising the upper opening and the side opening.

4. The LED light bulb as claimed in claim 3, wherein the bulb base comprises a bulb base body and a separation cap, the bulb base body comprising a cylindrical circuit board fixing cap and a heat sink installation portion surrounding an outer side of the circuit board fixing cap, the separation cap being connected with an upper end of the circuit board fixing cap, the heat sink installation portion being gradually inclined from top to bottom toward the bulb axis, the second openings of the bulb base being disposed in the heat sink installation portion, two sides of each second opening having side insertion troughs, two sides of the lower part being respectively inserted in the side insertion troughs of the corresponding second opening.

5. The LED light bulb as claimed in claim 4, wherein a bottom end of each second opening has a bottom insertion trough, a bottom end of the lower part being inserted in the bottom insertion trough of the corresponding second opening.

6. The LED light bulb as claimed in claim 4, wherein the separation cap has connecting posts thereon, the connecting posts being gradually and outwardly inclined, the step of each heat sink having an insertion hole, the insertion holes of the steps of the heat sinks corresponding in position to the connecting posts, each connecting post having a wire hole for passing of a wire of the circuit board installed in the circuit board fixing cap.

7. The LED light bulb as claimed in claim 1, wherein the third opening has an inward opening flange, a top end of the inner side of each heat sink being against the opening flange.

8. The LED light bulb as claimed in claim 1, wherein the first opening of the lower part of each heat sink is a plurality of parallel grooves, the lower part being connected with the bulb base, the grooves communicating with the corresponding second opening of the bulb base.

9. The LED light bulb as claimed in claim 1, wherein the joint of the lower part of each heat sink and the connecting portion has an outside-in transverse trough to form the first opening, the lower part being connected with the bulb base, the transverse trough communicating with the corresponding second opening of the bulb base.

10. The LED light bulb as claimed in claim 1, wherein the first opening of the lower part of each heat sink is a plurality of holes.

11. The LED light bulb as claimed in claim 2, 8, 9 or 10, wherein the bulb housing comprises an upper bulb housing and a lower bulb housing, the upper bulb housing having the third opening.

12. The LED light bulb as claimed in claim 2, 8, 9 or 10, wherein the third opening of the bulb housing is one of a hole, a plurality of holes, and a plurality grooves.

* * * * *